US005711357A

United States Patent [19]

Smith

[11] Patent Number: 5,711,357

[45] Date of Patent: Jan. 27, 1998

[54] ADJUSTABLE LOG SPLITTING HEAD

[76] Inventor: John R. Smith, 752 E. Hill Rd., Ludlow, Vt. 05149

[21] Appl. No.: 800,785

[22] Filed: Feb. 14, 1997

[51] Int. Cl.[6] ..... B27L 7/00

[52] U.S. Cl. ..... 144/195.1; 144/195.8; 144/366

[58] Field of Search ..... 144/4.6, 193.1, 144/195.1, 195.8, 366; 254/104

[56] References Cited

U.S. PATENT DOCUMENTS

| | | | |
|---|---|---|---|
| 4,078,591 | 3/1978 | Syrjala | 144/195.1 |
| 4,269,242 | 5/1981 | Smith et al. | 144/195.1 |
| 4,294,295 | 10/1981 | Olin | 144/4.6 |
| 4,353,401 | 10/1982 | Schilling | 144/195.1 |
| 4,371,019 | 2/1983 | Jeffrey | 144/195.1 |
| 4,371,020 | 2/1983 | Barnes et al. | 144/366 |
| 4,373,564 | 2/1983 | Heikkinen | 144/366 |
| 4,391,312 | 7/1983 | Sakraida | 144/195.8 |
| 4,685,495 | 8/1987 | Freeman | 144/195.1 |
| 4,860,806 | 8/1989 | Brace | 144/195.8 |
| 5,287,902 | 2/1994 | Keantelot | 144/366 |

*Primary Examiner*—W. Donald Bray
*Attorney, Agent, or Firm*—Norman B. Rainer

[57] ABSTRACT

An adjustable multi-wedge splitting head for a log splitting apparatus equipped with a ram for axially advancing pre-cut logs toward the splitting head in a horizontal direction includes a vertically oriented stationary post and a stationary triangular splitting wedge disposed between the post and the log to be split. The post holds upper and lower multiple splitting wedge assemblies which can be slideably positioned on the post by hydraulic cylinder/piston units. The triangular splitting wedge severs a log into two pieces. The wedge assemblies then sever the initially produced two pieces into smaller pieces, the number of which corresponds to the number of blades in the assembly positioned to interact with the log.

12 Claims, 2 Drawing Sheets

ADJUSTABLE LOG SPLITTING HEAD

BACKGROUND OF THE INVENTION

1. Field of the Invention

This invention relates to apparatus for the splitting of wooden logs into small pieces useful as firewood.

2. Description of the Prior Art

Devices for converting logs into firewood generally employ a ram-type mechanism which forces logs of pre-cut length into a stationary wedge having sharpened edges. As the log is axially advanced into the wedge, the log splits into a plurality of sector-shaped pieces along cleavage lines that are generally directed radially with respect to the center axis and along medullar rays of the log. Typical examples of such devices are disclosed in U.S. Pat. Nos. 4,294,295; 4,353,401; 4,371,019; 4,371,020; and 5,287,902.

The diameter of the logs fed to the splitting wedge may vary between about 4" and 24". The larger diameter logs must be cut into a greater number of pieces than the smaller diameter logs. In the course of cutting a sequence of logs, it often happens that logs of widely different diameter are encountered, thereby requiring frequent adjustment of the apparatus so that the appropriate number of pieces are generated from each log. Such. adjustment of the splitting conditions of the apparatus requires considerable operator time, thereby increasing the cost of the log-splitting operation.

U.S. Pat. No. 4,371,019 discloses a wedge which is adjustably positionable so as to center upon the log axis. However, none of the aforesaid patents disclose apparatus which permits quick and easy adjustment of the number of pieces to be generated from a given log.

Accordingly, a primary object of the present invention is to provide a wedge head for a log splitting apparatus whereby adjustment can be made so as to change the number of pieces that a given log will be split into.

It is another object of this invention to provide a wedge head as in the foregoing object wherein the adjustability of the splitting characteristic can be easily and quickly accomplished.

It is a further object of the present invention to provide a wedge head of the aforesaid nature which is of rugged and simple design amenable to low cost manufacture.

These objects and other objects and advantages of the invention will be apparent from the following description.

SUMMARY OF THE INVENTION

The above and other beneficial objects and advantages are accomplished in accordance with the present invention by an adjustable multi-wedge splitting head for a log splitting apparatus equipped with a ram and guide means for axially advancing pre-cut logs in a horizontal direction, said splitting head comprising:

a) a vertically oriented stationary post of substantially uniform rectangular cross-sectional configuration bounded by opposed front and rear flat surfaces, paired side surfaces, and upper and lower extremities, b) an elongated straight stationary splitting wedge disposed in vertical orientation forwardly of said front surface, c) upper and lower multiple splitting wedge assemblies slideably mounted upon and removable from said post, and d) activating means which controllably slide said multiple wedges upon said post.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
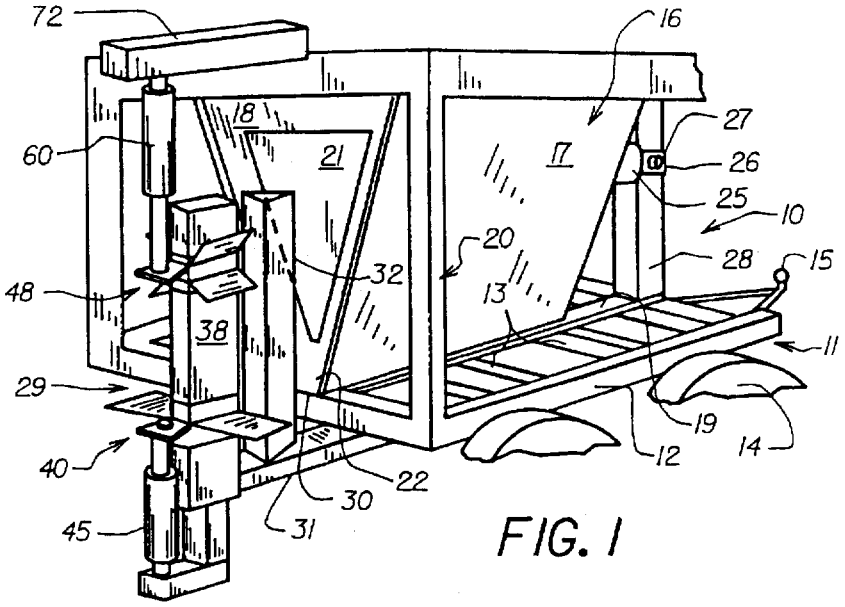
FIG. 1 is a rear and side perspective view showing an embodiment of the splitting head of the present invention in association with a conventional log splitting apparatus.
Figure 2:
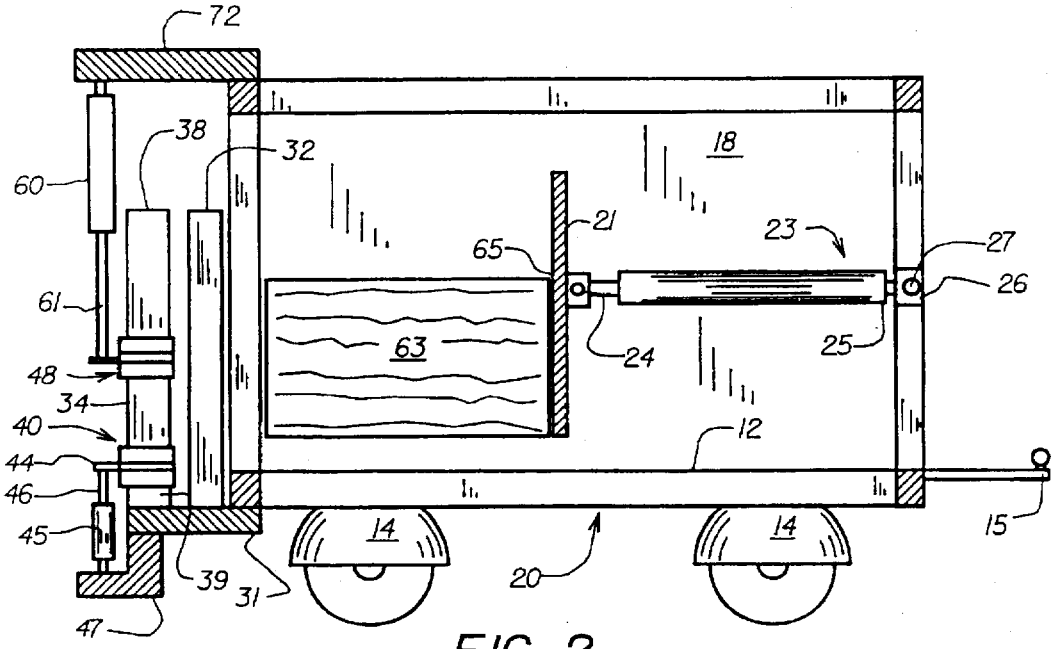
FIG. 2 is a side view, partially in section, of the splitting head and apparatus of FIG. 1.
Figure 3:
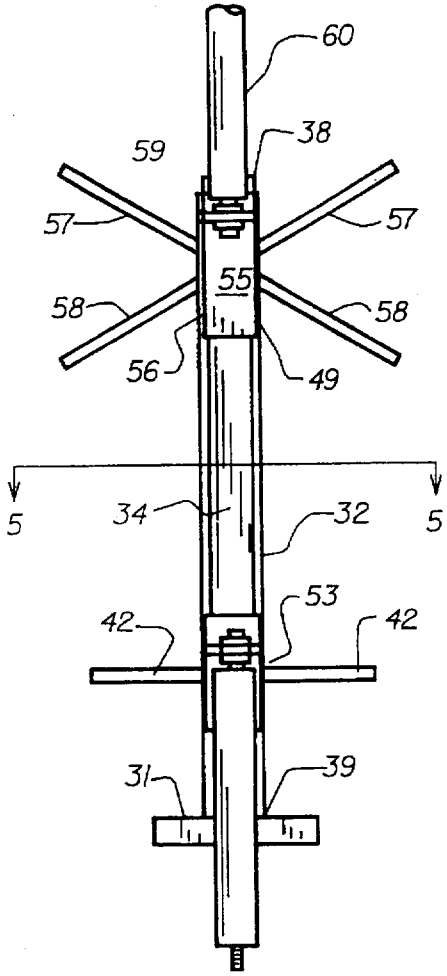
FIG. 3 is a rear view of the splitting head of FIG. 1.
Figure 4:
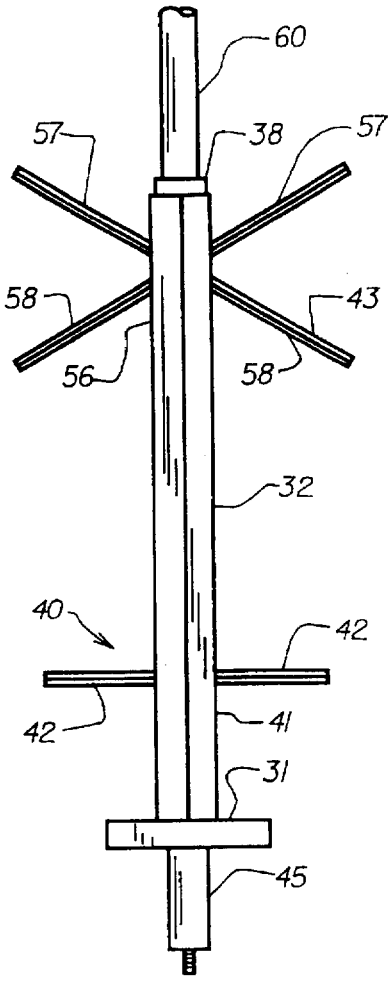
FIG. 4 is a front view of the splitting head.
Figure 5:
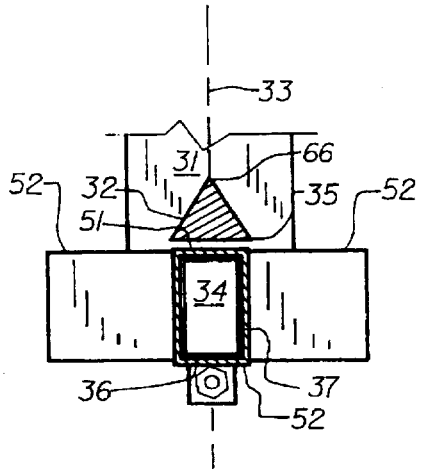
FIG. 5 is a sectional view taken in the direction of the arrows upon the line 5—5 of FIG. 3.

Referring to the drawings, a mobile log splitting apparatus, generally designated 10, embodying the present invention is shown comprised of a chassis or framework, generally designated 11, which includes spaced longitudinally extending side members 12, joined by spaced cross members 13, to form a unitary structure. The chassis 11 is mounted on four wheels 14 in a conventional manner and is provided with a conventional trailer tongue 15 whereby the log splitting apparatus 10 may be attached, for example, to a pickup truck, tractor or other prime mover and transported to a desired location.

A generally V-shaped open top guide chute 16 is mounted on chassis 11 and extends longitudinally thereof, said guide chute being comprised of a pair of inclined side walls 17 and 18 supported at the apex of the V by a longitudinally extended stringer 19 on chassis 11. The side walls 17 and 18 are also supported by a framework, generally designated 20 carried by the chassis 11.

A drive member 21, shown having a V-shaped contour is mounted for reciprocal movement in the generally V-shaped passageway 22 defined by side walls 17 and 18 of chute 16. In other equivalent embodiments, said drive member may have other contours while maintaining a substantially flat rear face 65. Said reciprocal movement of drive member 21 is achieved through the agency of a hydraulic ram 23 having a distal extremity 24 that engages the front face of drive member 21. The proximal extremity 25 of ram 23 is secured by way of clevis 26 and pin 27 to a vertically extending beam 28 which forms a part of framework 20.

In the illustrated embodiment, a multiple wedge splitting head 29 of the present invention is mounted on support beam 31 attached to framework 20 adjacent the exit rear end 30 of guide chute 16. Splitting head 29 includes an elongated straight stationary splitting wedge 32 of triangular shape disposed in vertical orientation and centered upon a plane of symmetry 33 that bisects the V-shape of guide chute 16. The forwardly directed cutting edge 66 of wedge 32 is disposed within said plane of symmetry.

A vertically oriented stationary post 34 of substantially uniform rectangular cross sectional configuration is positioned rearwardly of wedge 32 in alignment therewith in centered relationship upon plane 33. Post 34 is bounded by opposed flat front and rear surfaces 35 and 36, respectively, paired flat side surfaces 37, and upper and lower extremities 38 and 39, respectively. It is to be noted that, whereas lower extremity 39 abuts against support beam 31, to which it is attached, upper extremity 38 is free and unencumbered. In alternative embodiments, however, supporting arms attached to framework 20 may removably engage the upper extremity of post 34.

A lower multiple splitting wedge assembly 40 includes a collar 41 slideably positionable upon post 34, and comprised of forward and back panels 51 and 52, respectively, and opposed side panels 53. Wedge members 42 are horizontally emergent from side panels 53 and have forwardly directed sharp edges 52. Activating means in the form of hydraulic cylinder 45 having piston rod 46, is interactive between control tab 44 rearwardly emergent from back panel 52, and lower securing means in the form of L-shaped bracket beam 47 pendently secured to support beam 31.

An upper multiple splitting wedge assembly 48 includes a collar 49 slideably positionable upon post 34, and comprised of forward and back panels 54 and 55, respectively, and opposed side panels 56. An upper pair of wedge members 57 is emergent from side panels 56 in upwardly angled disposition. A lower pair of wedge members 58 is emergent from side panels 56 in downwardly angled disposition. All said wedge members have forwardly directed sharp edges 43. A control tab 59 is attached to back panel 55. Activating means in the form of hydraulic cylinder 60 having piston rod 61 is interactive between control tab 59 and upper securing means in the form of overhead beam 72 attached to framework 20.

In the operation of the splitting head of the present invention, a log 63 having a pre-cut length of between about 15 and 25 inches is dropped into chute 16 from overhead supply means. Drive member 21 is then urged against the log by ram 23, an action which forces the opposite extremity of the log into contact with stationary vertical wedge 32, with consequent cleavage of the log into two halves.

When upper wedge assembly 48 is positioned above the log, and lower wedge assembly 40 is centered upon the axis of the log, the two horizontally disposed wedge members 42 split in two the two halves of the log, thereby producing four pieces of firewood from the initial log. Alternatively, when, lower wedge assembly 40 is positioned below the log and, upper wedge assembly 48 is centered upon the axis of the log, the upper and lower pairs of wedge members split into three sectors each half of the log, thereby producing six pieces of firewood from the initial log.

For further adjustability, the upper wedge assembly 48 can be easily removed from post 34 by upward movement, and replaced with an assembly having three pairs of wedge members, thereby producing eight pieces of firewood from the initial log.

In an alternative embodiment of the adjustable multi-wedge splitting head of the present invention, the vertical post is not employed, and the wedge assemblies are slideably mounted upon and removable from the stationary splitting wedge While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. An adjustable multi-wedge splitting head for a log splitting apparatus equipped with a ram and guide means for axially advancing pre-cut logs toward said splitting head in a horizontal direction, said splitting head comprising:

a) a vertically oriented stationary post of substantially uniform rectangular cross-sectional configuration bounded by opposed front and rear flat surfaces, paired side surfaces, and upper and lower extremities, b) an elongated straight stationary splitting wedge disposed in vertical orientation forwardly of said front surface, c) upper and lower multiple splitting wedge assemblies slideably mounted upon and removable from said post, and d) activating means which controllably slide said multiple splitting wedge assemblies upon said post.

2. The splitting head of claim 1 wherein said guide means is of generally upwardly opening V-shaped contour.

3. The splitting head of claim 2 having a vertical plane of symmetry that bisects said guide means.

4. The splitting head of claim 3 wherein said stationary splitting wedge is of triangular shape, having a forwardly directed cutting edge disposed within said plane of symmetry.

5. The splitting head of claim 1 wherein said activating means are hydraulic cylinders.

6. The splitting head of claim 1 wherein each wedge assembly is comprised of a collar slideably positionable upon said stationary post and having forward, back and opposed side panels, and wedge members emergent from said side panels.

7. The splitting head of claim 1 wherein the back panel of said collar is provided with a control tab which engages said activating means.

8. The splitting head of claim 1 wherein said splitting wedge assemblies can be removed from said post by sliding upward beyond the upper extremity of said post.

9. The splitting head of claim 1 wherein said log splitting apparatus is further equipped with an exterior framework that serves to secure the various components of said apparatus.

10. The splitting head of claim 9 wherein said activating means is interactive between said framework and said splitting wedge assemblies.

11. A log splitting apparatus comprising a wheeled framework having a ram and guide means for axially advancing pre-cut logs in a horizontal direction toward a splitting head of claim 1.

12. An adjustable multi-wedge splitting head for a log splitting apparatus equipped with a ram and guide means for axially advancing pre-cut logs toward said splitting head in a horizontal direction, said splitting head comprising:

a) an elongated straight stationary splitting wedge disposed in vertical orientation, b) upper and lower multiple splitting wedge assemblies slideably mounted upon and removable from said splitting wedge, and c) activating means which controllably slide said multiple splitting wedge assemblies upon said splitting wedge.

* * * * *